US008079835B2

(12) United States Patent
Lo et al.

(10) Patent No.: US 8,079,835 B2
(45) Date of Patent: Dec. 20, 2011

(54) AIR COMPRESSOR

(76) Inventors: An-Shun Lo, Shulin (TW); Ying-Po Hsieh, Taipei (TW)

( * ) Notice: Subject to any disclaimer, the term of this patent is extended or adjusted under 35 U.S.C. 154(b) by 462 days.

(21) Appl. No.: 12/357,415

(22) Filed: Jan. 22, 2009

(65) Prior Publication Data

US 2010/0166583 A1 Jul. 1, 2010

(30) Foreign Application Priority Data

Dec. 26, 2008 (TW) ..... 97223336 U

(51) Int. Cl.
*F04B 43/00* (2006.01)

(52) U.S. Cl. ..... 417/473; 417/269

(58) Field of Classification Search ..... 417/269, 417/271, 472, 473, 112
See application file for complete search history.

(56) References Cited

U.S. PATENT DOCUMENTS 1,994,146 A * 3/1935 Ochel ..... 417/298
2,021,156 A * 11/1935 Smith ..... 417/472
5,088,903 A * 2/1992 Tomatsu ..... 417/473
6,112,707 A * 9/2000 Kirk ..... 123/65 BA
6,547,541 B1 * 4/2003 Nishio ..... 417/472
6,575,712 B1 * 6/2003 Slavchev ..... 417/331
7,726,330 B2 * 6/2010 Schuster ..... 137/225
2004/0018098 A1 * 1/2004 Beckman et al. ..... 417/234
2004/0141862 A1 * 7/2004 Cornwell ..... 417/441
2005/0002810 A1 * 1/2005 Gould et al. ..... 417/472
2006/0071965 A1 * 4/2006 Igarashi et al. ..... 347/19
2006/0104825 A1 * 5/2006 Etter et al. ..... 417/234
2006/0239828 A1 * 10/2006 Igarashi et al. ..... 417/22
2008/0069708 A1 * 3/2008 Beckman ..... 417/410.1

* cited by examiner

*Primary Examiner* — Nimeshkumar Patel
*Assistant Examiner* — Mary Ellen Bowman
(74) *Attorney, Agent, or Firm* — Leong C. Lei

(57) ABSTRACT

An air compressor includes a chassis that supports thereon a motor, a transmission set, and a plurality of extendible barrels. The transmission set includes a clutch that is operatively coupled to the motor through a belt. Two eccentric rotation members are respectively arranged on opposite sides of and coupled to the clutch. Each eccentric rotation member is coupled to a crank arm, which has a moving end connected to the extendible barrel. The extendible barrel is provided with an air inlet port and an air outlet port. When the motor is set in operation, the transmission set drives the extendible barrels to move carry out reciprocal and axial compression to delivery compressed air. The present invention features easy maintenance and can carry out a noise-free operation.

1 Claim, 8 Drawing Sheets

AIR COMPRESSOR

TECHNICAL FIELD OF THE INVENTION

The present invention generally relates to an air compressor that generates pressurized air, and particularly to an air compressor that comprises eccentric rotation members that are set in rotation to cause reciprocal compression of extendible barrels for realizing noise-free operations.

DESCRIPTION OF THE PRIOR ART

Pressurized air is advantageous in low costs and low pollution in providing mechanical power. Thus, it is widely used to actuate pneumatic devices, pneumatically operated tools or to smooth the operation of machines. An air compressor is often employed to convert atmospheric air into pressurized air and the operation of the air compressor is that a motor is used to drives a piston to reciprocate inside a cylinder for drawing air into the cylinder and to compress the air into pressurized air for direct use or storage in a high-pressure air canister. With the evolution of techniques, various pneumatic tools are available in the market to replace the human labor and improve the operation efficiency.

However, a conventional air compressor often generates a great noise during its operation, and this is basically due to the mechanical structure thereof. For an open type conventional air compressor, when it is set in a regular-load operation, the noise generated will be as high as 90 dB. Such a high noise often causes damage to human body, such as shrinkage of blood vessel, increase of blood pressure, dizziness, and being easily irritated. Taiwan Utility Model No. 162789 discloses a silent, high heat dissipation box-like air compressor, which arranged parts of the air compressor inside a main enclosure box that is formed by side boards, whereby the enclosed box blocks the outward emission of the noise. A motor arranged inside the box has a spindle that has an exposed distal end coupled to a multi-blade fan. The fan induces an air flow that is delivered by an air conduit toward a cylinder and a fan-like belt pulley arranged at a front end of the cylinder, whereby the great amount of cooling air that is blown toward the parts of the air compressor provides high performance of heat dissipation.

This solution, however, does not realize eliminate the noise problem induced by the conventional air compressor, for it can at most lower the noise level and improve heat dissipation. Thus, the present invention aims to provide an air compressor that uses a transmission system that induces up-and-down reciprocation and an extendible barrel that is made of resilient and elongation-resisting material, both together replacing the parts of the conventional air compressor, such as cylinder and cylinder head to eliminate the noise caused by the conventional way of air compression.

SUMMARY OF THE INVENTION

The primary objective of the present invention is to provide an air compressor that features easy maintenance and is noise free in the operation thereof.

To achieve the above objective, the present invention provides an air compressor that comprises a chassis, a motor, a transmission set, and a plurality of extendible barrels, wherein the motor, the transmission set, and the extendible barrels are mounted on the chassis. The chassis forms bearing seats on opposite side portions thereof. The transmission set comprises a clutch that is operatively coupled to the motor through a belt. Two eccentric rotation members are respectively arranged on opposite sides of and coupled to the clutch and the eccentric rotation members have outer side face that are provided with shafts that are rotatably supported by the bearing seats. Each eccentric rotation member is coupled to a crank arm. Each extendible barrel has a circumferential surface forming corrugation that is comprised of a plurality of alternating troughs and ridges, each of which is provided with a reinforcing ring. The extendible barrel is provided, centrally at a top thereof, with an air inlet port and is also provided, centrally at a bottom thereof, with an air outlet port. Both the air inlet port and the air outlet port are provided with check valves and filters respectively.

In the operation of the present invention, the mechanical power generated by the operation of the motor is used to drive the rotation of the whole transmission set, causing the crank arms to move for inducing reciprocal motion that drives reciprocal and axial compression operation of the extendible barrels, whereby air is drawn into the extendible barrels through the air inlet ports, compressed by the extendible barrels, and then discharged through the air outlet ports of the extendible barrels as compressed air. The extendible barrels adopted in the present invention are resilient and elongation resisting, so that no noise will be generated during the operation of the present invention and efficient replacement and convenient maintenance can be quickly done when malfunctioning occurs.

The foregoing objective and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
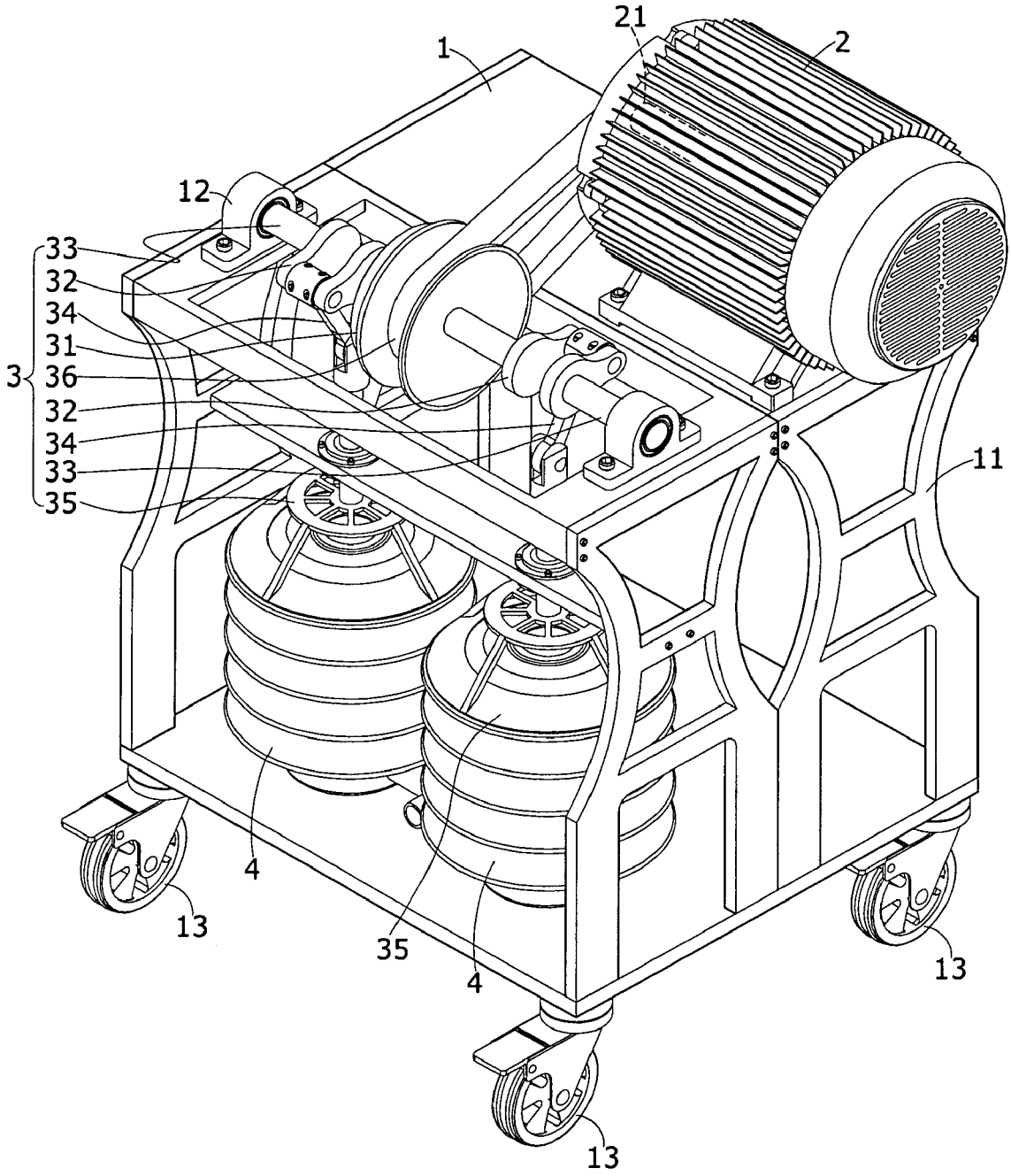
FIG. 1 is a perspective view of a preferred embodiment of the present invention.
Figure 2:
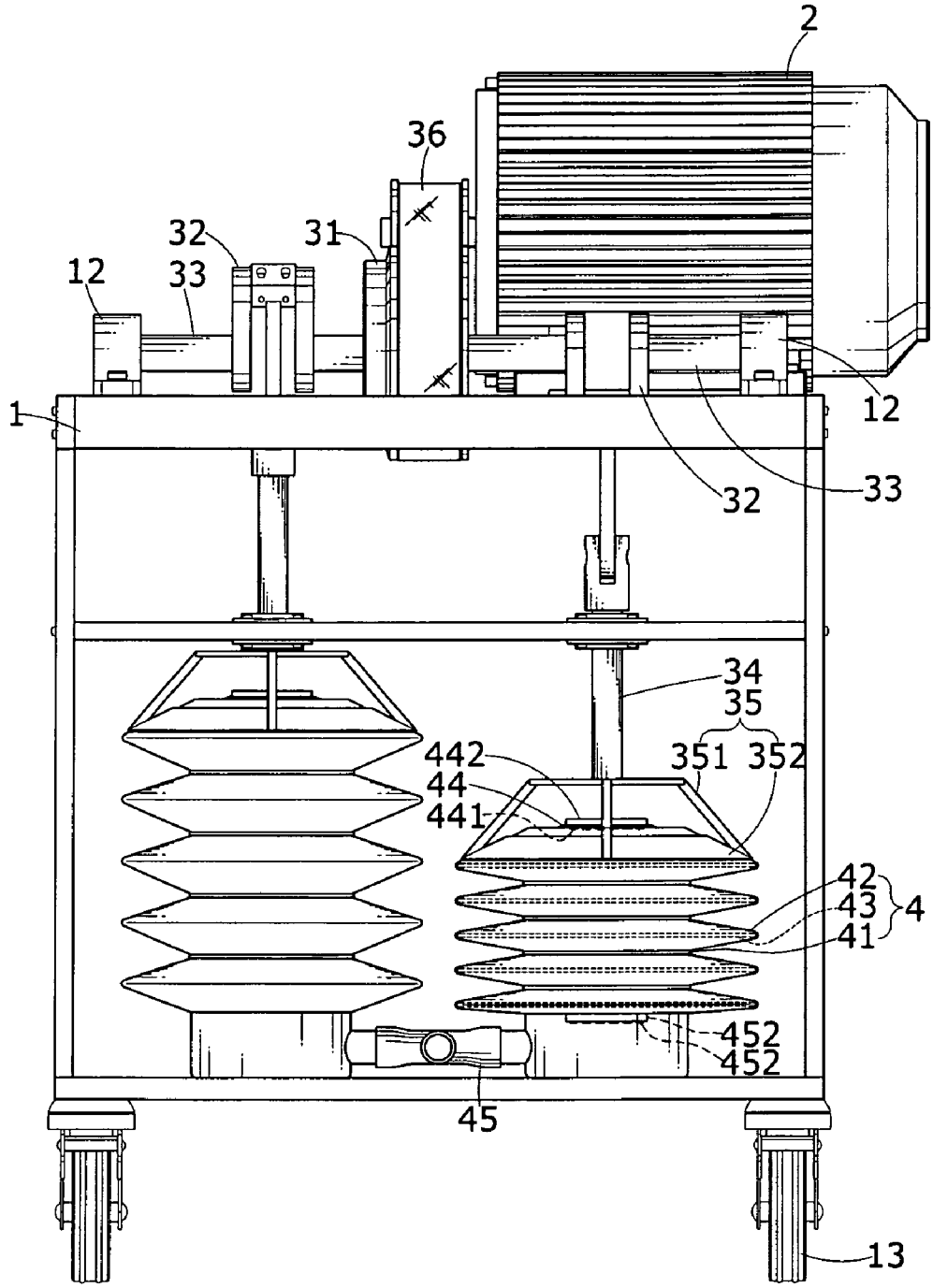
FIG. 2 is a side elevational view of the preferred embodiment with an extendible barrel being broken to show inside details.

With reference to the drawings and in particular to FIGS. 1 and 2, an air compressor constructed in accordance with a preferred embodiment of the present invention comprises a chassis 1, which is comprised of a plurality of frames 11. The chassis 1 forms a bearing seat 12 at a suitable location on each of opposite side portions thereof. Each bearing seat 12 contains therein bearing means that supports rotation. The chassis 1 has a bottom to which a plurality of casters 13 is mounted.

A motor 2 is mounted to one side portion of the chassis 1 and comprises a centrally arranged spindle 21. When the motor 2 is set in operation, the spindle 21 is continuously rotated.

A transmission set 3 is arranged between the bearing seats 12 in a co-axial manner. The transmission set 3 comprises a centrally located clutch 31. The clutch 31 has two opposite ends each respectively coupled to an eccentric rotation member 32 for example by an axle, whereby the eccentric rotation members 32 are arranged in a symmetric manner. Each eccentric rotation member 32 has an outer side face to which a shaft 32 is mounted for being rotatably supported in the corresponding bearing seat 12. Each eccentric rotation member 12 is coupled to a crank arm 34. The clutch 31 is operatively coupled to the motor 2 for being driven to continuously rotate, in order to set the eccentric rotation member 32 is continuous rotation. Since the eccentric rotation member 32 and the crank arm 34 are set in eccentric coupling with respect to each other, the crank arm 34 can induce an up-and-down reciprocal motion. The crank arm 34 has a moving end that is coupled to a connection seat 35, which comprises a plurality of radial bars 351 each having a lower end fixed to a ring 352. A belt 36 is arranged between the motor 2 and the clutch 31 to provide operative coupling therebetween.

A plurality of extendible barrels 4 is operatively and respectively coupled to the moving ends of the crank arms 34. Each barrel 4 has an outer circumferential surface forming alternating circumferential troughs 41 and circumferential ridges 42, each of which is provided with a reinforcing ring 43. Each extendible barrel 4 has a top on which an air inlet port or opening 44 is centrally mounted and a bottom on which an air outlet port or opening 45 is centrally mounted, wherein the ring 352 of the connection seat 35 is set on the top of the extendible barrel 4 and air outlet port 45 is exposed. The air inlet port and the air outlet port 45 are respectively provided with a check valve 441, 451 and a filter 442, 452 and the air inlet port 44 has an opening size that is greater that an opening size of the air outlet port 45 to ensure the realization of air compression.

Figure 3:
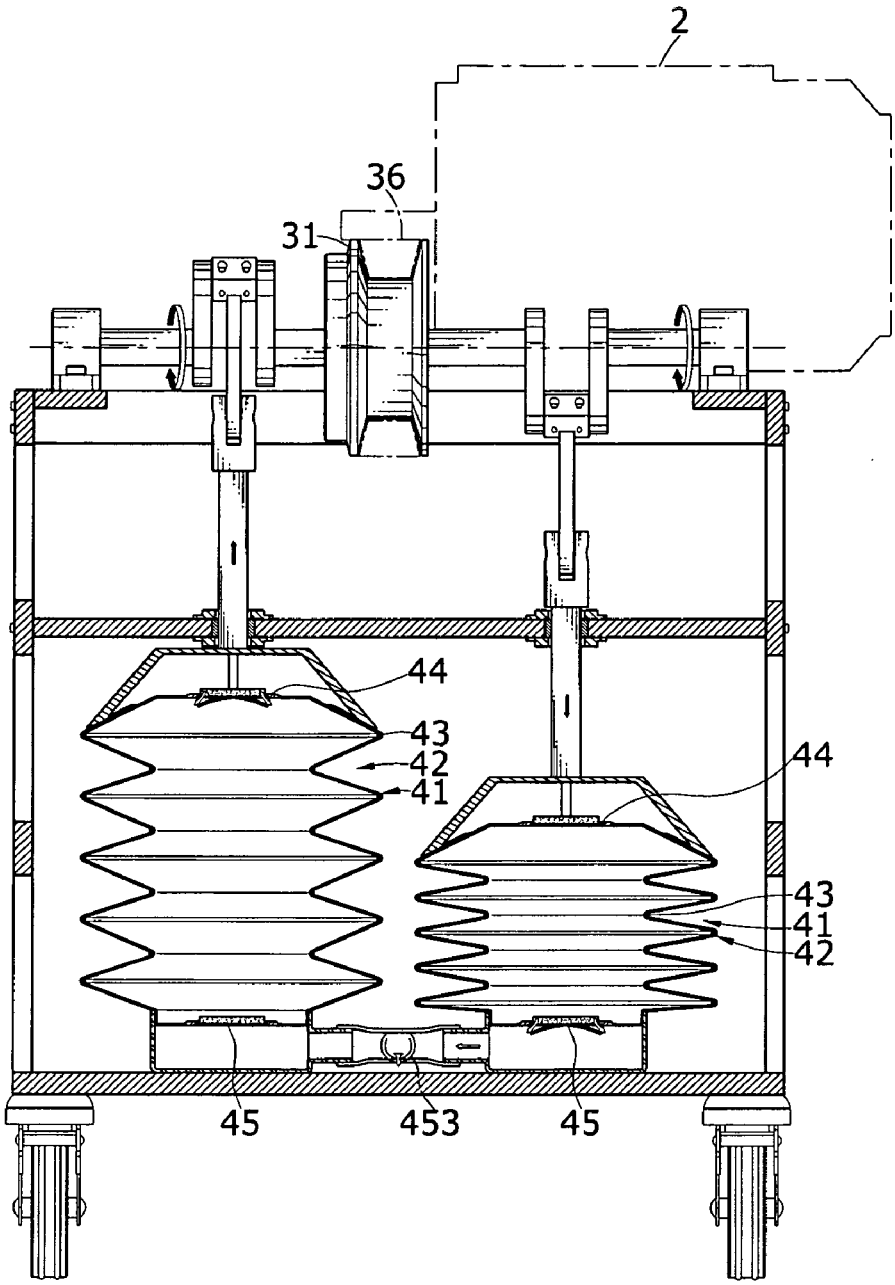
FIG. 3 is a schematic view illustrating the operation of the preferred embodiment of the present invention.
Figure 4:
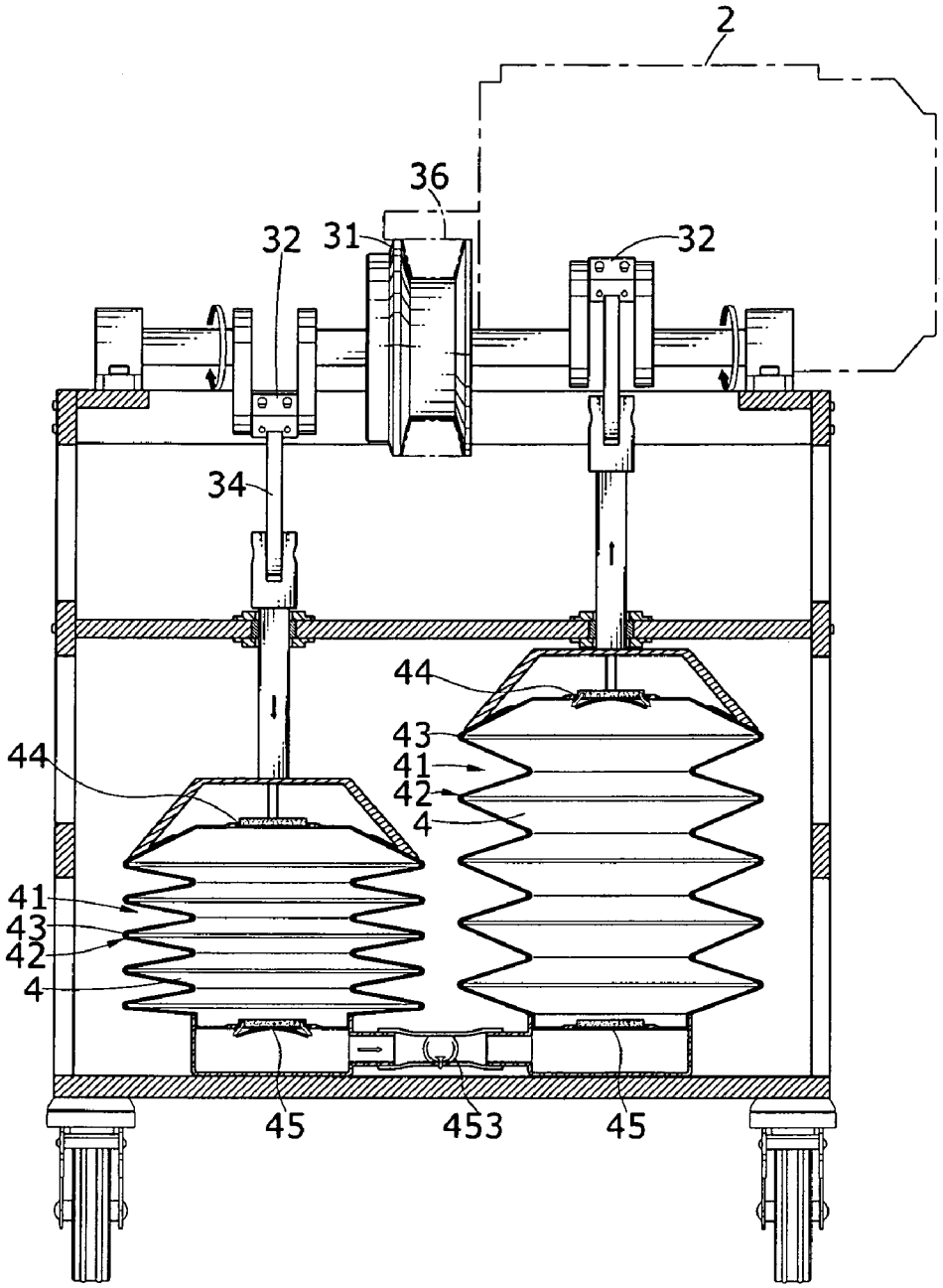
FIG. 4 is another schematic view illustrating the operation of the preferred embodiment of the present invention.
Figure 8:
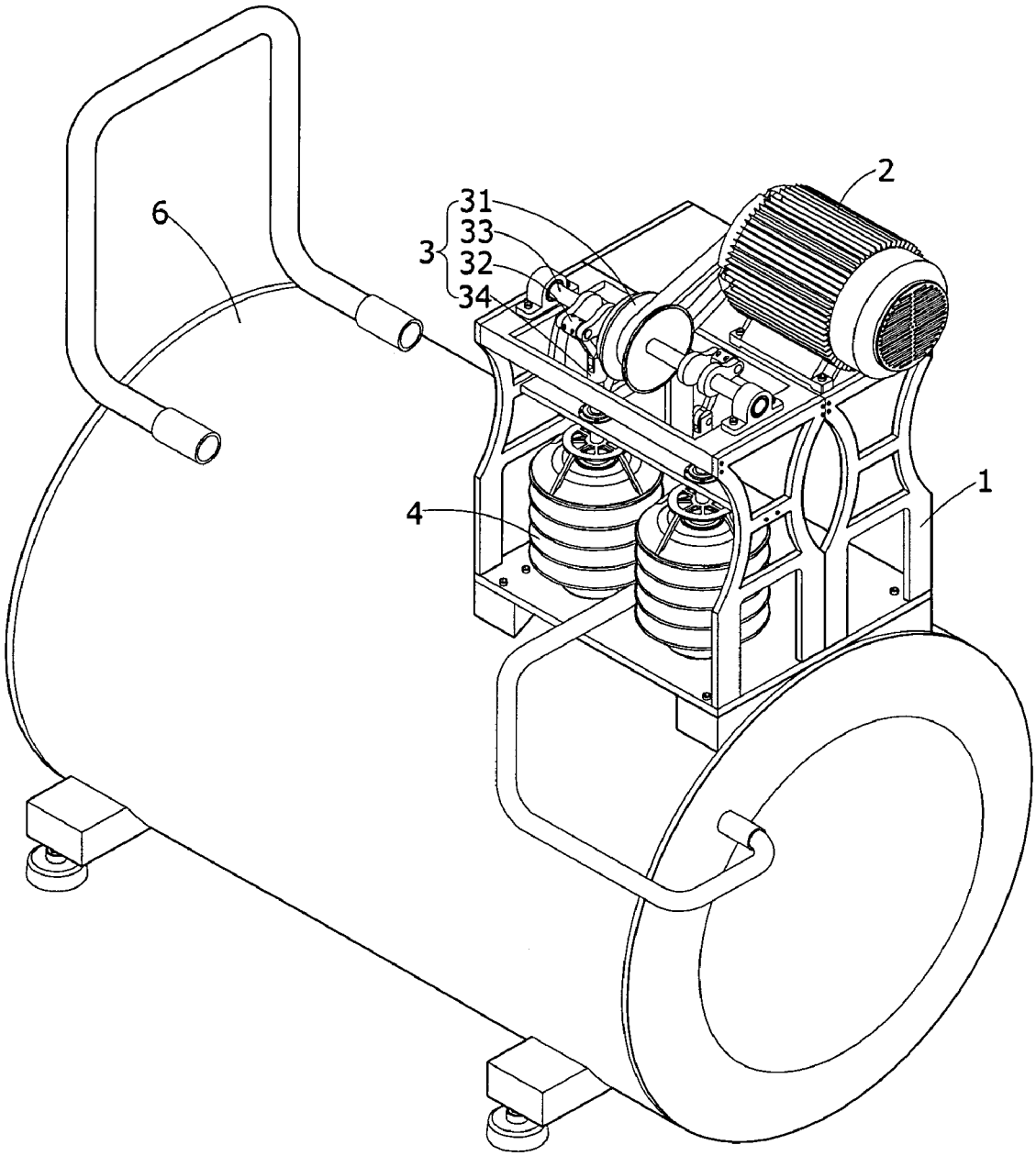
FIG. 8 is a perspective view illustrating the preferred embodiment of the present invention mounted to a high-pressure air canister.

In operation, as shown in FIGS. 1, 3, and 4, the spindle 21 of the motor 2 is operatively coupled to the clutch 31 through the belt 36 so that the power transmitted through the spindle 21 of the motor 2 can drive the rotation of the clutch 31, which is preferably constructed to change the rotation speed in accordance with the load (namely being easy or difficult to compress the extendible barrel 4), whereby the eccentric rotation members 32 set on opposite sides of the clutch 31 may respectively drive the crank arms 34 to reciprocate in the up-and-down direction and in turn drive the extendible barrels 4 on the opposite sides to carry out axial reciprocal compression operation. When the extendible barrel 4 is extended in the upward direction, air is drawn into the extendible barrel 4 through the air inlet port and when the extendible barrel 4 is depressed in the downward direction, also due to that the opening size of the air outlet port 45 is smaller than that of the air inlet port 44, the air inside the extendible barrel 4 is compressed and then discharged. The air outlet port 45 is connected to an connection port 453 that functions to directly discharge the compressed air or to convey the compressed air into a high-pressure air canister 6 (see FIG. 8) for storage. Further, the extendible barrel 4 is made of a material sheet that is comprised of multiple layers of tensile-resisting material stacked together and forming corrugation of alternating troughs 41 and ridges 42, each of which is provided with a reinforcing ring 43, whereby when the extendible barrel 4 is compressed, undesired bulging that leads to damage to the extendible barrel 4 can be prevented.

Figure 5:
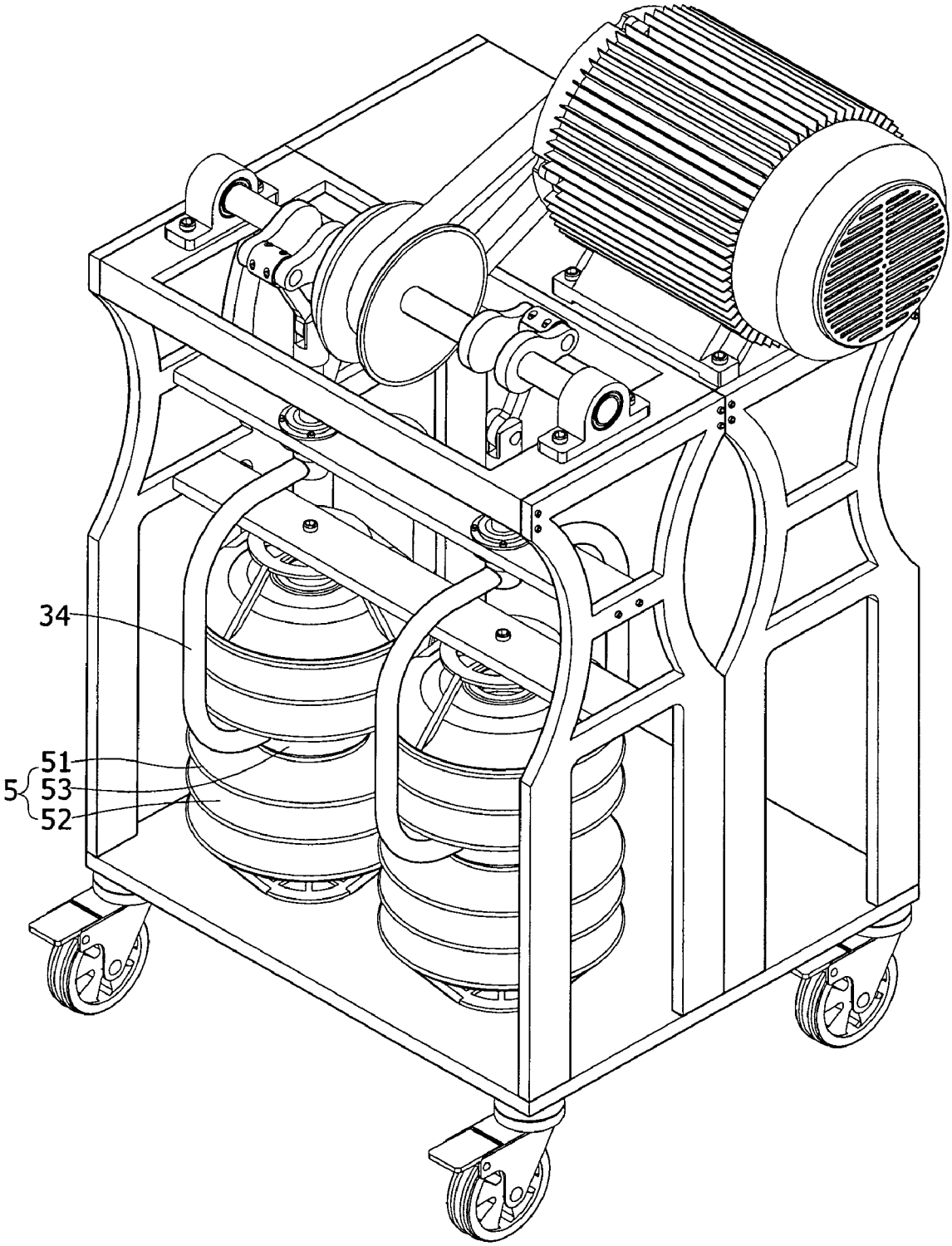
FIG. 5 is a perspective view of another embodiment of the present invention.
Figure 6:
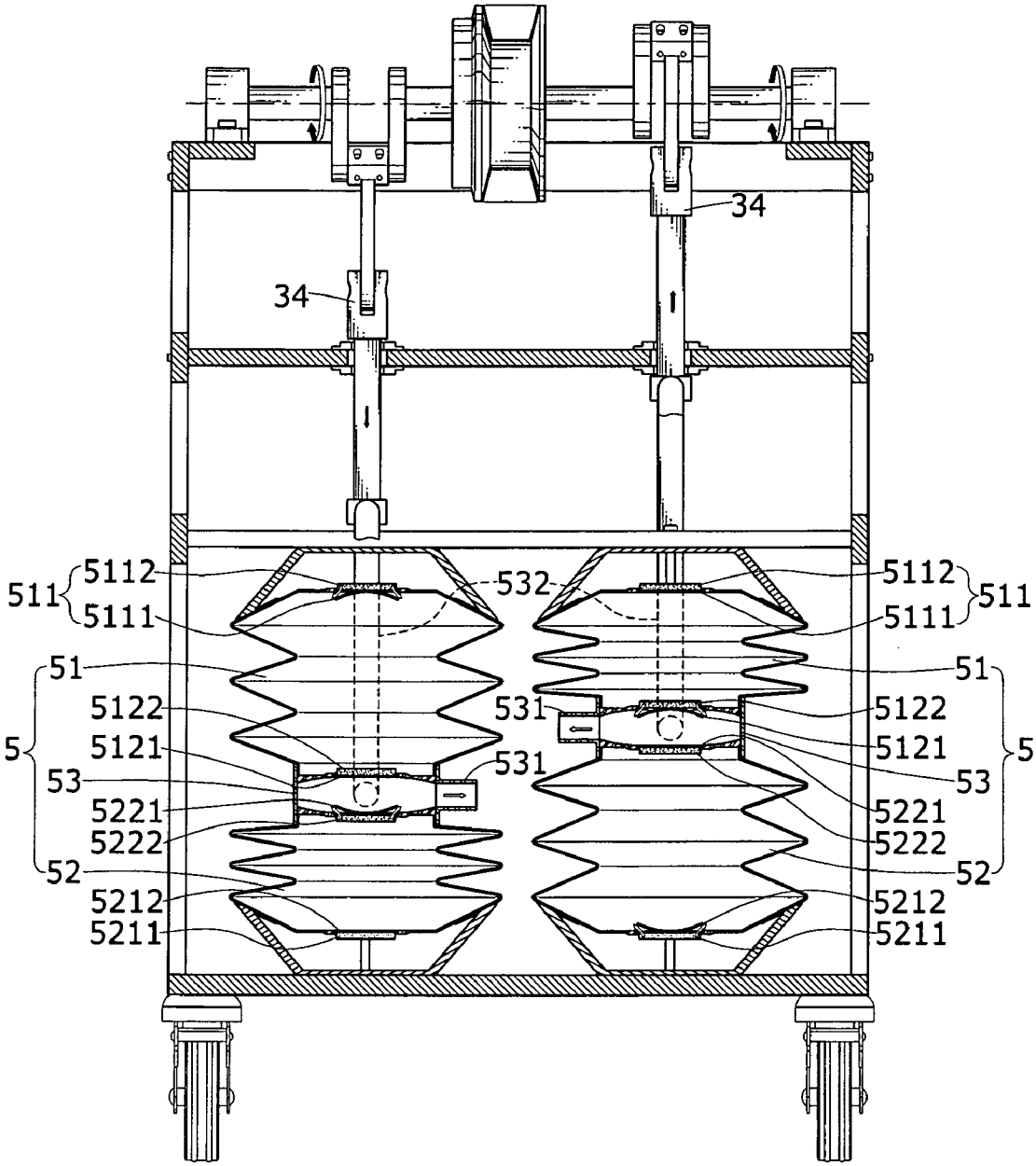
FIG. 6 is a schematic view illustrating the operation of said another embodiment of the present invention.
Figure 7:
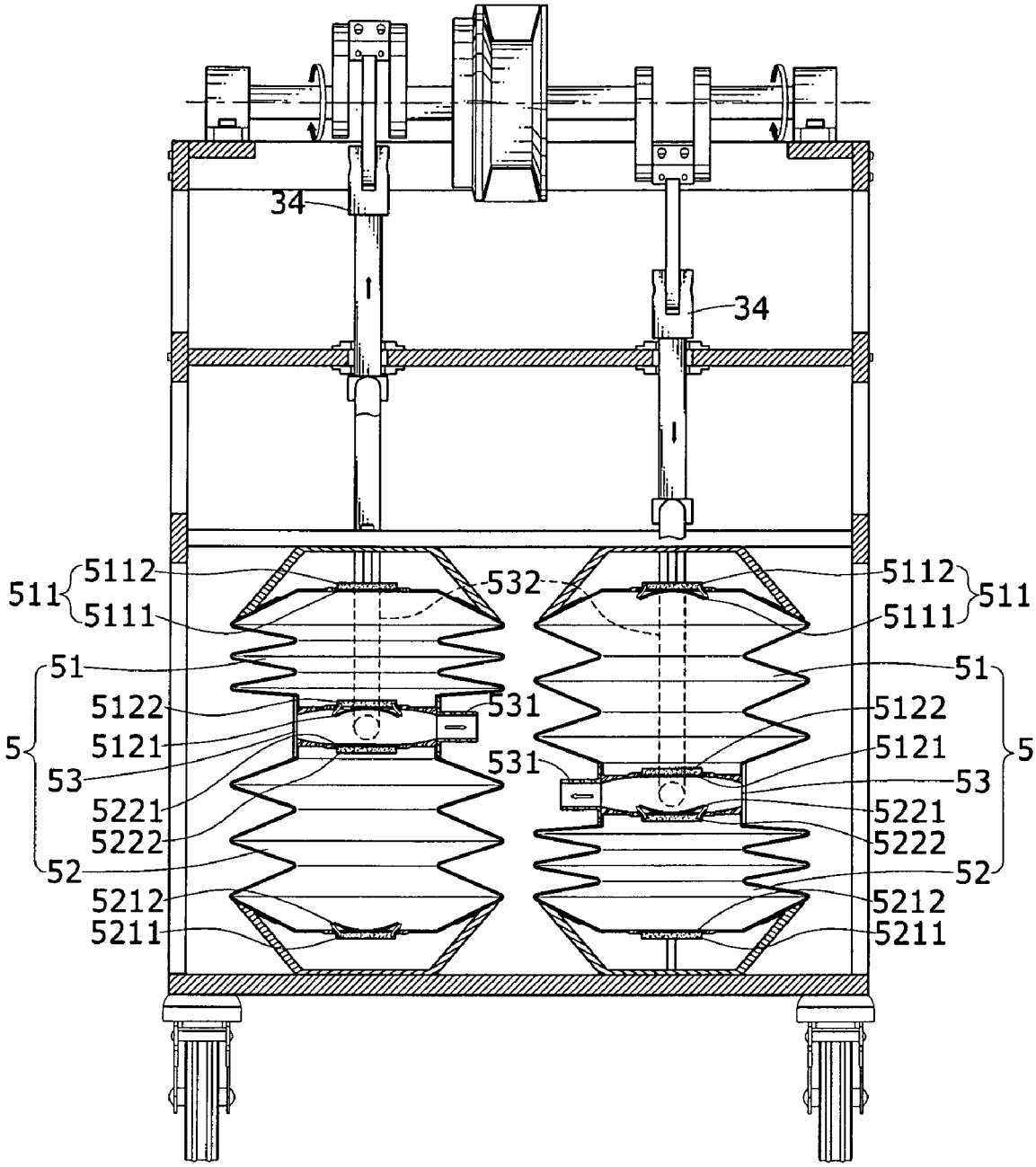
FIG. 7 is another schematic view illustrating the operation of said another embodiment of the present invention.

Referring to FIGS. 5-7, an air compressor constructed in accordance with another embodiment of the present invention is illustrated, in which a major change is made in the configuration of the extendible barrel 4, which in the instant embodiment is replaced by a two-sectioned extendible barrel 5 with the moving end of the crank arm 34 connected to an intermediate portion of the two-sectioned extendible barrel 5. The two-sectioned extendible barrel 5 comprises a first extendible barrel section 51 and a second extendible barrel section 52, which are stacked in an axial direction with an air outlet port 512 of the first extendible barrel section 51 facing an air outlet port 522 of the second extendible barrel section 52. The connection between the first and second extendible barrel sections 51, 52 is provided with an air passage ring 53 that has a circumference to which a plurality of outlet openings 531 and mounting portions 532 are provided. The mounting portions 532 are respectively mounted to the moving ends of the crank arms 34. Further, the first extendible barrel section 51 has an air inlet port 511 and the air outlet port 512, which are both provided with check valves 5111, 5121 and filters 5112, 5122 and the air inlet port 511 has an opening size that is greater that an opening size of the air outlet port 522; similarly, the second extendible barrel section 52 has an air inlet port 521 and the air outlet port 522, which are both provided with check valves 5211, 5221 and filters 5212, 5222 and the air inlet port 521 has an opening size that is greater that an opening size of the air outlet port 522, whereby in a single operation cycle, suction, compression, and discharge of air can all be done to thereby substantially enhance the operation performance.

To this point, it is apparent that the present invention offers the following advantages:

(1) The present invention uses the motor 2 to drive the transmission set 3 and the extendible barrels 4 and also structurally reinforces the extendible barrels 4, whereby in a single operation cycle, suction, compression, and discharge of air can all be done to thereby provide excellent operation efficiency, give off no noise in the operation thereof, and allow efficient replacement for simplifying the maintenance and repairing in a malfunctioning evener.

(2) Further, the present invention provides casters 13 on the bottom of the chassis 1 to facilitate maneuverability thereof.

(3) In addition, the present invention also provides a two-sectioned extendible barrel 5 that substantially enhances the operation performance.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

We claim:

1. An air compressor comprising:

a chassis forming bearing seats on opposite side portions thereof;

a motor, mounted to the chassis;

a transmission set arranged between the bearing seats, comprising a centrally located clutch and having two opposite ends which is respectively coupled to an eccentric rotation member by an axle, each eccentric rotation member having an outer side face to which a shaft is mounted for being rotatably supported in the bearing seat, each eccentric rotation member being coupled to a crank arm, the clutch being operatively coupled to the motor for being driven to continuously rotate;

a plurality of extendible barrels each operatively coupled to a moving end of the crank arm, each barrel having an outer circumferential surface forming alternating circumferential troughs and circumferential ridges, each of which is provided with a reinforcing ring, each barrel having a top on which an air inlet port is centrally mounted and a bottom on which an air outlet port is centrally mounted;

the moving end of each crank arm is connected to a connection seat that comprises a plurality of radial bars each having a lower end mounted to a ring, the ring being set on the top of the extendible barrel so as to expose the air outlet port.

* * * * *